US010028538B2

(12) United States Patent
Spitzfaden

(10) Patent No.: US 10,028,538 B2
(45) Date of Patent: Jul. 24, 2018

(54) COLLAR CORRECTOR

(71) Applicant: Andrew Spitzfaden, St. Louis, MO (US)

(72) Inventor: Andrew Spitzfaden, St. Louis, MO (US)

(73) Assignee: Collar Doc LLC, St. Louis, MO (US)

( * ) Notice: Subject to any disclaimer, the term of this patent is extended or adjusted under 35 U.S.C. 154(b) by 0 days.

(21) Appl. No.: 15/065,191

(22) Filed: Mar. 9, 2016

(65) Prior Publication Data

US 2016/0278437 A1 Sep. 29, 2016

Related U.S. Application Data

(60) Provisional application No. 62/137,515, filed on Mar. 24, 2015.

(51) Int. Cl.
*A41B 3/00* (2006.01)
*A41B 3/06* (2006.01)

(52) U.S. Cl.
CPC ..... *A41B 3/06* (2013.01)

(58) Field of Classification Search
CPC ..... A41B 3/06; A41B 3/00
USPC ..... 2/132, 129, 260.1; 223/84
See application file for complete search history.

(56) References Cited

U.S. PATENT DOCUMENTS 2,487,284 A 11/1949 Thomas
2,595,133 A * 4/1952 Golden ..... A41B 3/06 2/132
2,615,167 A * 10/1952 Sarff ..... A41B 3/06 2/132
3,256,129 A * 6/1966 Wallerstein ..... B65D 63/10 156/176
4,118,803 A 10/1978 Blau
D312,985 S 12/1990 Sprick
4,975,983 A 12/1990 Everett
5,626,267 A * 5/1997 Peruski ..... A41B 3/06 2/129
6,089,422 A * 7/2000 Gibson ..... A41B 3/10 2/129
2005/0160520 A1* 7/2005 Forrest ..... A41B 3/06 2/255
2007/0204374 A1 9/2007 Bier et al.
2007/0277293 A1* 12/2007 Koepp ..... A41B 3/06 2/256
2009/0038049 A1 2/2009 West
2010/0313331 A1 12/2010 English
2011/0113526 A1 5/2011 Harris
(Continued)

OTHER PUBLICATIONS http://cyangguang.en.alibaba.com.

(Continued)

*Primary Examiner* — Tejash Patel
(74) *Attorney, Agent, or Firm* — Reichel Stohry LLP; Mark C. Reichel; Natalie J. Dean

(57) ABSTRACT

A collar corrector is provided having an adhesive strip with at least one adhesive side. The adhesive strip removably attaches the collar corrector to a shirt collar. A non-adhesive strip is removably attached to the adhesive side of the adhesive strip. The non-adhesive strip is removed prior to removably attaching the collar corrector to the shirt collar. A wire is embedded within the adhesive strip. The wire is pliable to alter a shape of the collar corrector. The shape of the collar corrector is maintained by the wire.

18 Claims, 6 Drawing Sheets

(56) References Cited

U.S. PATENT DOCUMENTS

| | | | | |
|---|---|---|---|---|
| 2011/0289650 | A1* | 12/2011 | Arrona | A41B 3/06 2/129 |
| 2015/0157057 | A1* | 6/2015 | Truong | A41B 3/06 2/256 |

OTHER PUBLICATIONS http://shop.nordstrom.com/s/john-varvatos-star-usa-wire-collar-sport-shirt/3276737.
http://www.taperwire.com.
http://www.smarthome.com.

* cited by examiner

COLLAR CORRECTOR

CROSS-REFERENCE TO RELATED APPLICATIONS

The present application is a non-provisional of and claims priority to U.S. Provisional Patent Application 62/137,515, filed Mar. 24, 2015 and having the title "COLLAR CORRECTOR," the text and the drawings of which are incorporated herein in their entirety.

FIELD OF THE EMBODIMENTS

The present embodiments relate to collared shirts, and more particularly to a collar corrector for collared shirts.

BACKGROUND OF THE DISCLOSED EMBODIMENTS

People often desire to wear collared shirts, for example dress shirts or polo shirts, in a casual manner. Generally, this means that the shirt is worn with at least one of the top buttons undone. Unfortunately, unbuttoning the top buttons of the shirt frequently causes the shirt to flare open, thereby exposing the wearer's chest. This may be undesirable and unattractive. Additionally, even when wearing a shirt buttoned, the collar of the shirt may become disoriented, wrinkled, or out of place.

Collar correctors may be used to hold the collar stationary and prevent the collar from flaring. Some known collar correctors are sold sewn into the shirt. Alternatively, a wire may be sewn into the shirt after the shirt is purchased. Unfortunately, having a collar corrector sewn into the shirt may cause damage to the shirt over time. For example, the collar corrector may become damaged when the shirt is washed and dried. The collar corrector may also become deformed over time thereby permanently deforming the collar. Other known collar correctors are sold separately from the shirt and positioned in the collar when the shirt is worn. These known collar correctors are configured to be inserted into a slot in the collar designed to retain a collar stay. Unfortunately, the collar stay slots formed in shirts are not universal in size. As such, known collar correctors may not be sized appropriately for all shirts. The known collar correctors also include a wire that extends around the entire collar from one collar stay slot to the opposite collar stay slot. However, the wire is only secured in the collar stay slots. To properly hold the collar, the wire must stay positioned at the fold in the collar along the entire length of the collar. It is common for the wire of known collar correctors to drop out of position at the fold in the collar and possibly below the collar where the wire is visible. Accordingly, known collar correctors have several disadvantages in that they may damage the shirt, they may become deformed, they may not be properly sized to the shirt, and/or they may fall out of position.

A need remains for a collar corrector that can be removably attached to a shirt so that the collar corrector does not damage or deform the shirt over time. A need also remains for a collar corrector that is usable with any shirt and remains positioned at the fold in the collar when in use.

SUMMARY OF THE DISCLOSED EMBODIMENTS

The present embodiments provide a collar corrector having an adhesive strip with at least one adhesive side. The adhesive strip removably attaches the collar corrector to a shirt collar. The adhesive strip may be formed from at least one of cloth or plastic. A non-adhesive strip is removably attached to the adhesive side of the adhesive strip. The non-adhesive strip is removed prior to removably attaching the collar corrector to the shirt collar. In one embodiment, the adhesive strip may include two adhesive sides. Each adhesive side has a non-adhesive strip removably attached thereto. A wire is embedded within the adhesive strip. The wire is pliable to alter a shape of the collar corrector. The shape of the collar corrector is maintained by the wire. The wire extends an entire length of the adhesive strip. The collar corrector may have a length that is less than a length of the shirt collar. Alternatively, the collar corrector may have a length that is sized a length of the shirt collar. In one embodiment, the wire is a 19 gauge wire.

In another embodiment, the present embodiments include a method of correcting a shirt collar that includes providing a collar corrector having a wire embedded within an adhesive strip, wherein the adhesive strip includes at least one adhesive side. The adhesive side of the collar corrector is removably attached to the shirt collar so that the wire of the collar corrector is positioned adjacent to a fold in the shirt collar. The collar corrector is then removed from the shirt collar after the shirt has been worn. An end of the collar corrector may be positioned adjacent to an end of the shirt collar. In one embodiment, the collar corrector includes two adhesive sides. A first adhesive side of the collar corrector is removably adhered to a shirt collar of a first shirt. The collar corrector is then removed from the shirt collar of the first shirt after use. A second adhesive side of the collar corrector is then removably adhered to a shirt collar of a second shirt.

Further areas of applicability of the present embodiments will become apparent from the detailed description provided hereinafter. It should be understood that the detailed description and specific examples, while indicating the preferred embodiment, are intended for purposes of illustration only and are not intended to limit the scope of the embodiments.

BRIEF DESCRIPTION OF THE DRAWINGS

The present embodiments will become more fully understood from the detailed description and the accompanying drawings, wherein.

DETAILED DESCRIPTION OF THE DISCLOSED EMBODIMENTS

Figure 1:
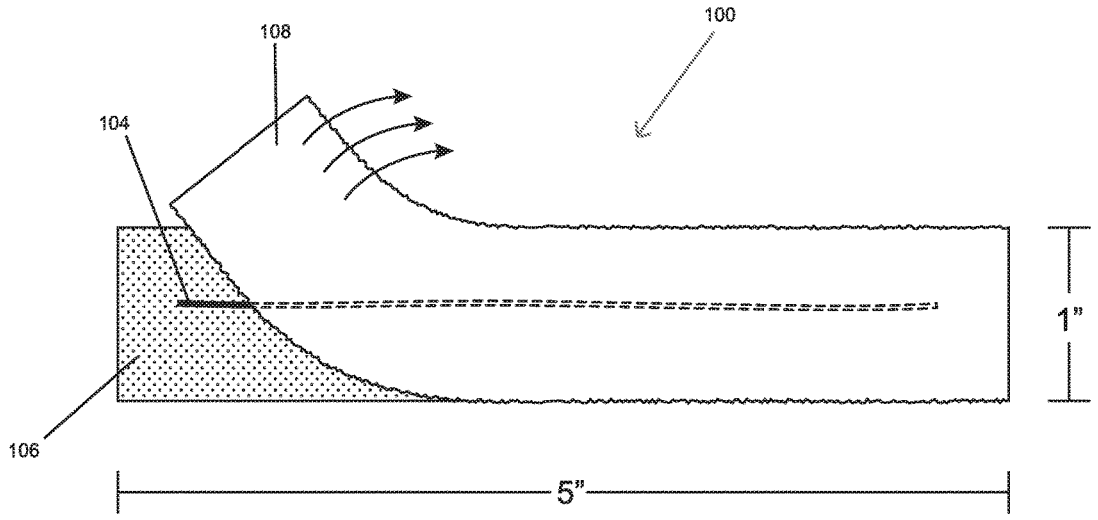
FIG. 1 is top schematic view of a collar corrector formed in accordance with an embodiment.
Figure 2:
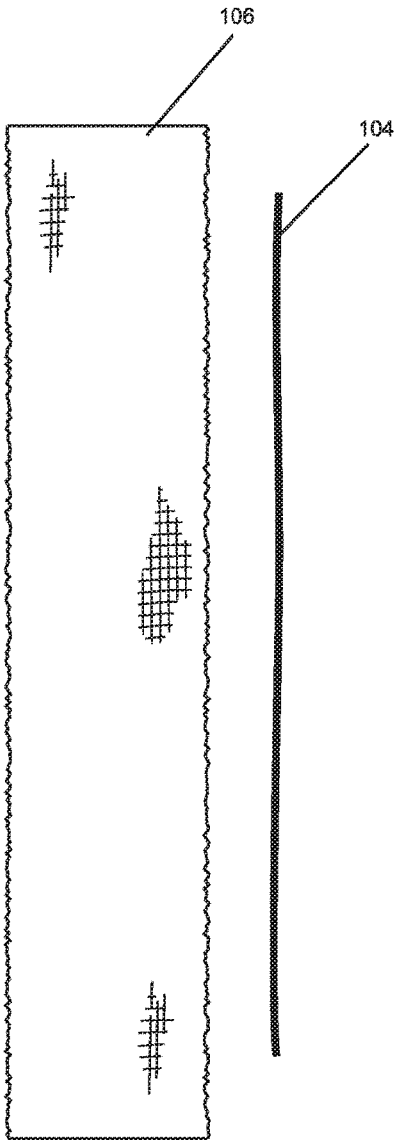
FIG. 2 is a top view of an adhesive strip and a wire used to form the collar corrector shown in FIG. 1.
Figure 3:
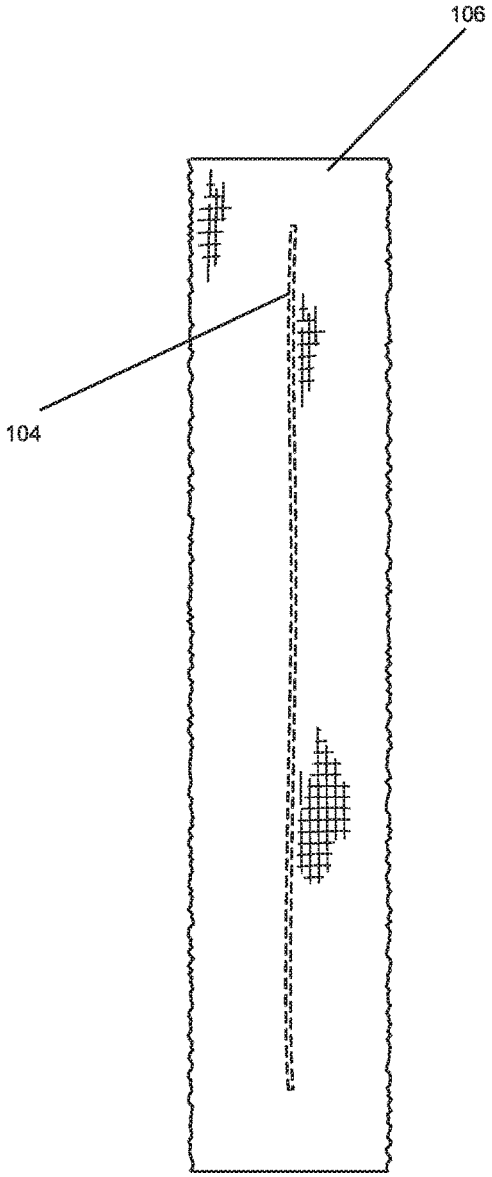
FIG. 3 is a top view of the collar corrector shown in FIG. 1.
Figure 4:
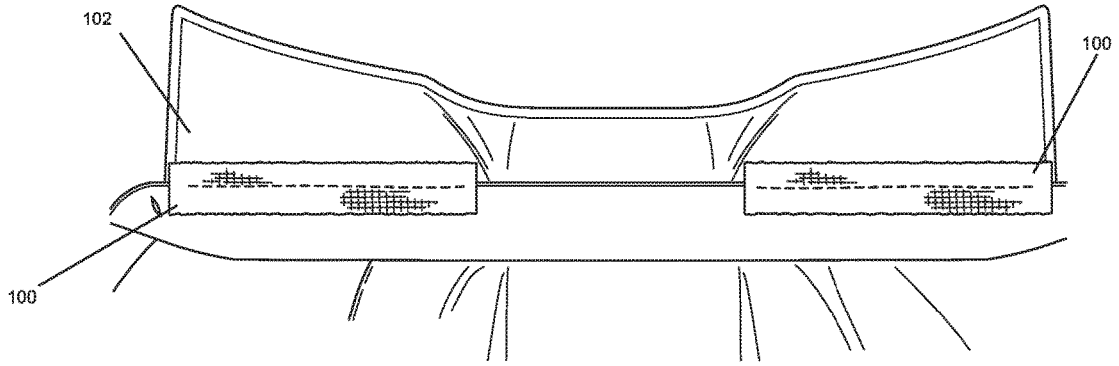
FIG. 4 is a top view of a pair of collar correctors shown in FIG. 1 adhered to a shirt.
Figure 5:
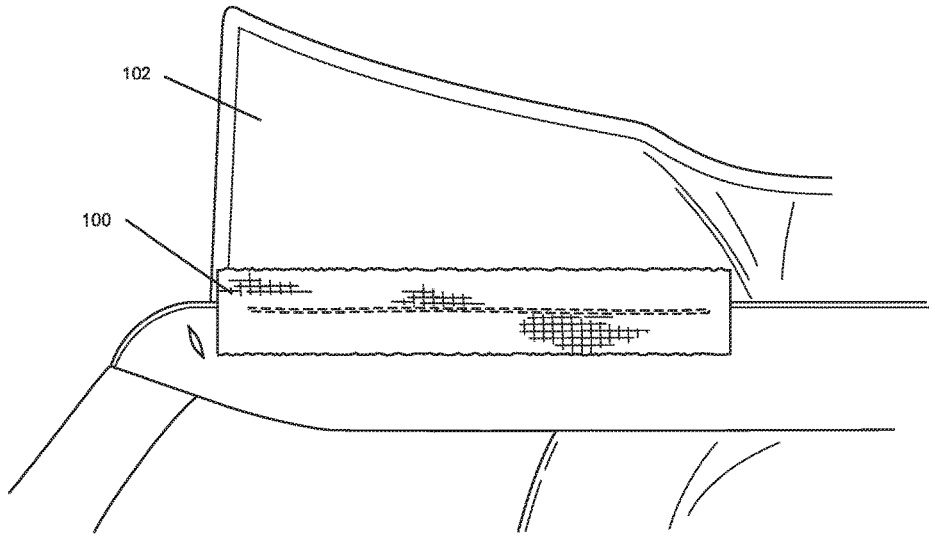
FIG. 5 is a top view a collar corrector shown in FIG. 1 adhered to a shirt.
Figure 6:
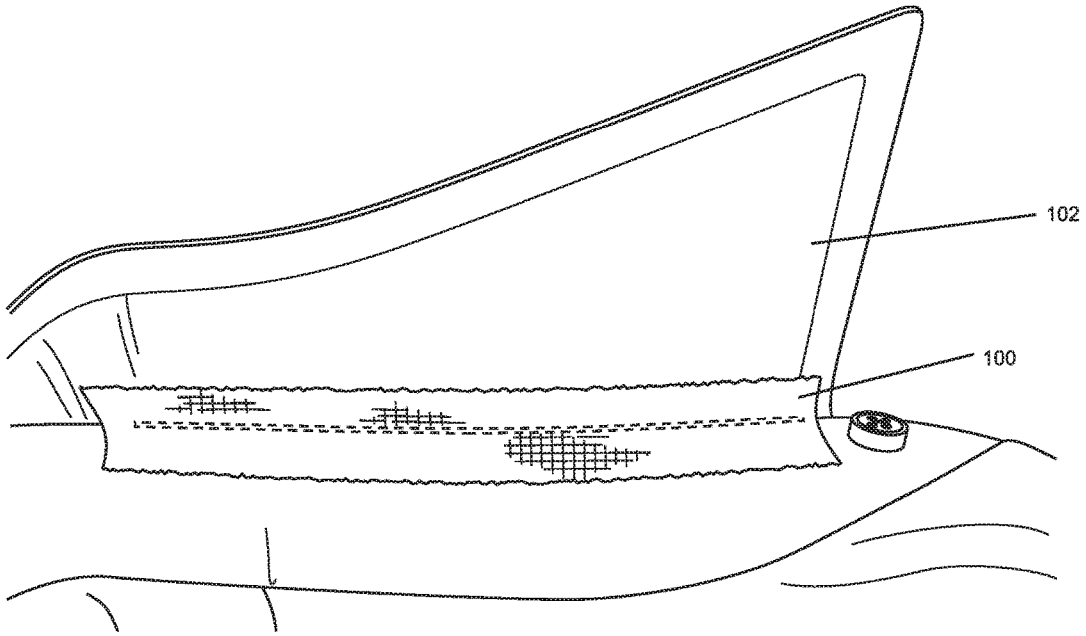
FIG. 6 is a top view a collar corrector shown in FIG. 1 adhered to a shirt.
Figure 7A:
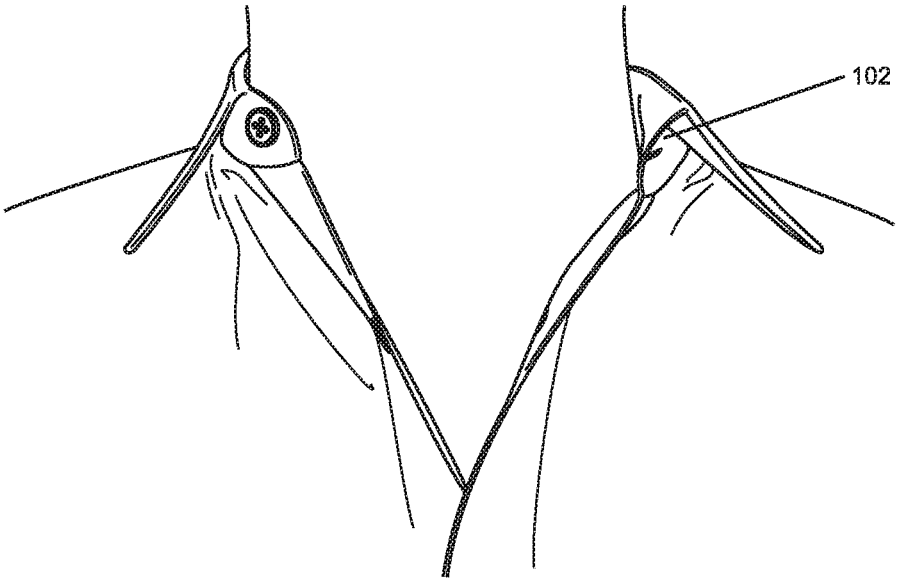
FIG. 7A is a before view of a shirt without a collar corrector.
Figure 7B:
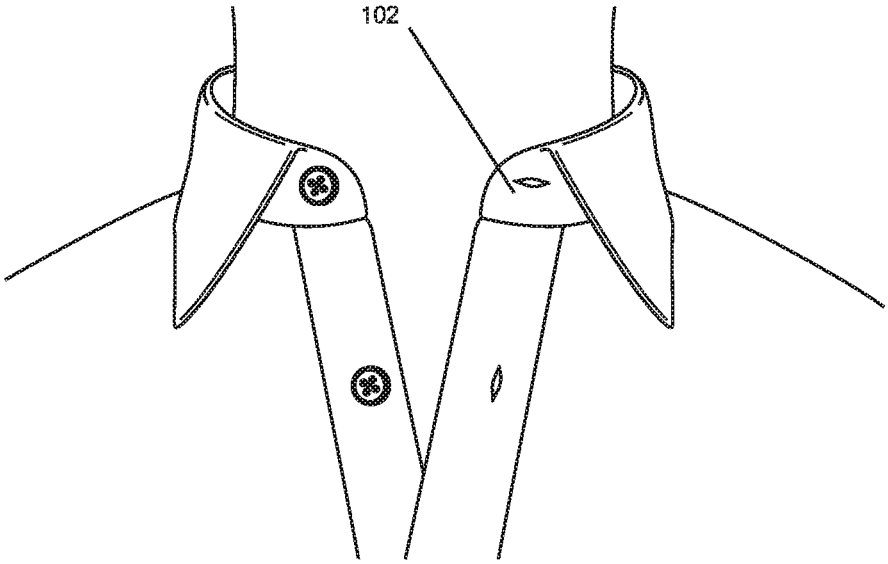
FIG. 7B is an after view of a shirt having the collar corrector shown in FIG. 1 adhered thereto.
Figure 8:
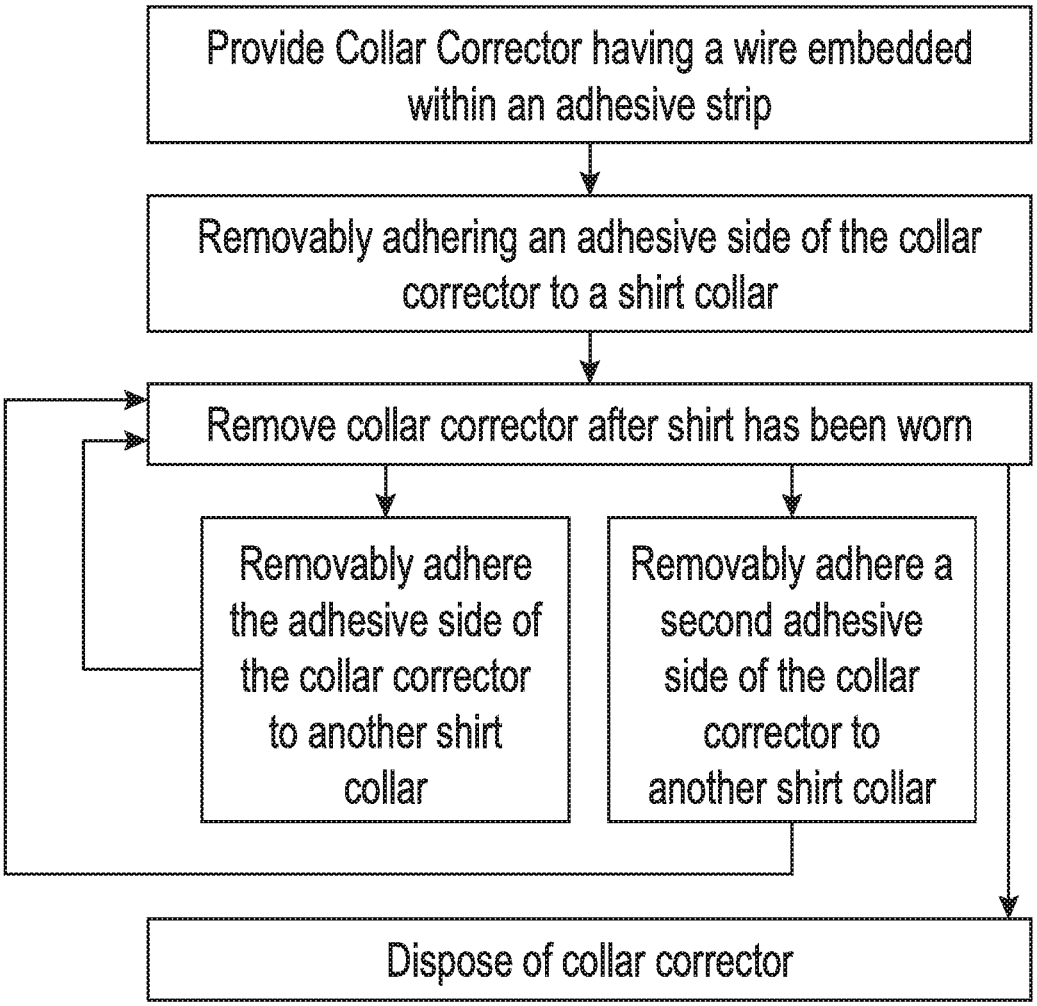
FIG. 8 illustrates a method of using a collar corrector formed in accordance with an embodiment.

The following description of the preferred embodiment(s) is merely exemplary in nature and is in no way intended to limit the embodiments, its application, or uses.

The present embodiments include a collar corrector 100 that can be removably attached to a shirt collar 102 so that the collar corrector 100 does not damage or deform the shirt over time. The collar corrector 100 is usable with any shirt and remains positioned at the fold in the shirt collar 102 when in use. The collar corrector 100 may be used with any type of shirt having a collar, for example, but not limited to, a dress shirt, a polo shirt, a rugby shirt, or a jersey. The collar corrector 100 may also be used with jackets and/or any other garment having a collar. The present embodiments include a temporary, removable collar corrector 100 that adheres with an adhesive 106 to the shirt collar 102. The collar corrector 100 includes a pliable wire 104 that may be bent to position the collar 102 as desired. Accordingly, the collar corrector 100 can be bent to provide more or less flare in the shirt collar 102. After wearing the shirt, the collar corrector 100 is removed so that the collar corrector 100 does not damage the shirt during cleaning or over time. In one embodiment, the adhesive portion 106 of the collar corrector 100 may be reusable so that the collar corrector 100 may be reused with another shirt. Alternatively, the collar corrector 100 may include multiple adhesive sides 106. As such, the collar corrector 100 may be reused by using each of the adhesive sides 106 with a different shirt.

The present embodiments may be formed from materials such as silk medical tape and a 19 gauge pliable wire 104. The present embodiments may be a 5"×1" strip where both sides have adhesive tape 106 stick and are covered with a peel off non-adhesive material 108 that would hide the adhesive sides 106. The 19 gauge type pliable wire 104 would be built in or embedded into the tape in order to allow the user to mold their collar how they please. In one embodiment, two strips 100A would be used per shirt on each end of the collar. Each strip 100A may be used at least two times by preserving the adhesive nature of the strip 100A and using the strip 100A again before peeling off the opposite side. The strips 100A would be stuck on the undersurface of the collar 102 on both sides of the shirt. The strips 100A could be sold in packages containing multiple strips 100A. The strips 100A may be sold online or in department stores near the check out where shirts are sold.

The collar corrector 100 includes an adhesive strip 106 that may be formed from cloth, plastic, and/or any other material suitable for use with clothing. The adhesive strip 106 includes at least one adhesive side. In one embodiment, the adhesive strip 106 may include two adhesive sides. In yet another embodiment, the adhesive strip 106 may be formed as an elongated triangle, square, or cylinder having more than two sides. Any of the sides may be adhesive. The adhesive side includes an adhesive or glue that temporarily adheres to a shirt collar 102. The adhesive is disposed along an entire length of the adhesive strip 106. The adhesive is strong enough to secure the adhesive strip 106 to the shirt collar 102 throughout the entire use of the shirt without shifting on the collar or peeling off. However, the adhesive is also capable of being removed from the shirt collar without damaging the shirt, leaving adhesive marks on the shirt, or causing the adhesive strip 106 to fall apart. In one embodiment, the adhesive is capable of being used once to adhere the adhesive strip 106 to the shirt collar 102. In another embodiment, the adhesive may be capable of being removed from a first shirt, yet still have enough adhesive strength to be secured to at least one other shirt. Accordingly, the adhesive strip 106 may be reused.

In an embodiment having more than one adhesive side, the adhesive strip 106 may be used with a first shirt by securing a first adhesive side to the first shirt. The adhesive strip 106 may then be secured to a second shirt using the second adhesive side. As such, the adhesive strip 106 may be reused at least as many times as the adhesive strip 106 has adhesive sides. Additionally, each adhesive side may have enough adhesive strength to secure to more than one shirt. Accordingly, each adhesive side of the adhesive strip 106 may be used multiple times, thereby allowing the user to repeatedly reuse the adhesive strip 106 until the adhesive on each adhesive side is devoid of the adhesive strength to secure to the shirt.

A non-adhesive strip 108 is removably positioned along each adhesive side of the adhesive strip 106. The non-adhesive strip 108 is removed from the adhesive strip 106 prior to using the collar corrector 100. By removing the non-adhesive strip 108, the adhesive on the adhesive side is exposed so that the adhesive may be used to secure the adhesive strip 106 to the shirt collar 102. In an embodiment having more than one adhesive side, the non-adhesive strip 108 is removed from one of the adhesive sides so that the adhesive of one side is exposed for securing the collar corrector 100 to a first shirt collar. The non-adhesive strip 108 along the other adhesive sides remains attached so that the adhesive on those sides remains intact for future uses of the collar corrector 100. The collar corrector 100 may also be used with more than one adhesive side by removing multiple non-adhesive strips 108. In particular, a first adhesive side may be secured to the lower portion of the shirt collar 102 along the fold in the shirt collar and a second adhesive side may be secured to the upper portion of the shirt collar 102.

The adhesive strip 106 may be sold in small sections that are configured to secure to a portion of a shirt collar. For example, in one embodiment the adhesive strip 106 may be approximately five inches long. The adhesive strip 106 is configured to be secured to the fold in the collar so that an end of the adhesive strip 106 is positioned adjacent an end of the collar 102. One adhesive strip 106 is positioned at each end of the collar. The adhesive strip 106 is positioned so that it is not visible when the shirt is worn. In other embodiments, the adhesive strip 106 may have shorter or longer lengths. The length of the adhesive strip 106 may be determined by the length of the shirt collar 102 that is to be secured. The adhesive strip 106 may also have a length that sized to the length of the shirt collar 102. For example, the adhesive strip 106 may be sized specifically for a size 15 shirt collar 102 or any other size shirt collar. The adhesive strips 106 are then purchased based on the size shirt collar that the purchaser wears. The full length adhesive strip 106 is positioned at the fold in the collar 102 so that each end of the adhesive strip 106 is positioned adjacent an end of the shirt collar 102. The strip 106 extends along the fold between each end of the shirt collar 102. Optionally, the adhesive strip 106 may be sold in spools or the like. The adhesive strip 106 may then be cut to size by the user. For example, the user may cut approximately five inch adhesives strips 106 to be positioned at each end of the collar 102. Or the user may cut a full length adhesive strip 106 that extends between each end of the collar 102 along the fold in the collar 102.

A wire 104 is embedded within the adhesive strip 106. The wire 104 extends the entire length of the adhesive strip 106 and may be centered along a centerline of the adhesive strip 106. Alternatively, the wire 104 extends the length of the adhesive strip 106 off-center from the centerline of the adhesive strip 106. The wire 104 is preferably formed from a metal, but may be formed from other suitable materials. In one embodiment, the wire 104 is a 19 gauge wire; however, smaller or larger gauge wires may be used, for example, 18 or 20 gauge wires. The gauge of the wire 104 may be altered so long as the wire 104 remains pliable and retains its shape. The wire 104 is pliable and may be bent into various shapes. The wire 104 also maintains its shape after being bent into the desire shaped. As such, bending the wire 104 alters the shape of the collar corrector 100 and the shape is then maintained. The wire 104 may be bent to alter an amount of shirt collar flare provided by the collar corrector 100. The wire 104 may be bent so that the collar corrector 100 provides little flare in the shirt collar 102 when attached thereto. The wire 104 may also be bent to allow for more flare in the shirt collar 102. The wire 104 maintains its shape so that the collar corrector 100 maintains the desired flare in the shirt collar 102.

During use, the wire 104 is bent to achieve a desired shape of the collar corrector 100. A non-adhesive strip 108 is then removed from one of the adhesive sides of the adhesive strip 106. The exposed adhesive side is adhered to the shirt collar 102 along the fold in the shirt collar 102. Alternatively, the collar corrector 100 may be attached to the collar 102 itself to correct wrinkles or folds in the collar 102. An end of the collar corrector 100 is positioned adjacent an end of the collar 102. When using small strips, one strip is positioned at each end of the collar 102. Optionally, a full length collar corrector 100 is positioned along the entire length of the fold in the collar 102 so that each end of the collar corrector 100 is positioned adjacent to an end of the collar 102. After being positioned on the collar 102, the wire 104 may be further manipulated to achieve the desired shape of the shirt collar 102. After wearing the shirt, the collar corrector 100 is removed from the shirt. The collar corrector 100 may then be positioned on other shirts either using the same adhesive side or by removing another non-adhesive strip 108 and exposing a second adhesive side.

The embodiments were chosen and described to best explain the principles of the invention and its practical application to persons who are skilled in the art. As various modifications could be made to the exemplary embodiments, as described above with reference to the corresponding illustrations, without departing from the scope of the embodiments, it is intended that all matter contained in the foregoing description and shown in the accompanying drawings shall be interpreted as illustrative rather than limiting. Thus, the breadth and scope of the present embodiments should not be limited by any of the above-described exemplary embodiments, but should be defined only in accordance with the following claims appended hereto and their equivalents.

What is claimed is:

1. A collar corrector comprising:

an adhesive strip having at least one adhesive side, the adhesive strip removably attaching the collar corrector to a shirt collar;

a non-adhesive strip being removably attached to the adhesive side of the adhesive strip, the non-adhesive strip being removed prior to removably attaching the collar corrector to the shirt collar; and a wire embedded within the adhesive strip, the wire being pliable to alter a shape of the collar corrector, the shape of the collar corrector being maintained by the wire;

wherein the collar corrector is configured maintain a desired flare of the shirt collar by adhering a first portion of the adhesive strip to the shirt collar on a first side of a fold of the shirt collar and adhering a second portion of the adhesive strip to the shirt collar on a second side of the fold of the shirt collar so that the wire is positioned along the fold.

2. The collar corrector of claim 1, wherein the adhesive strip includes two adhesive sides, each adhesive side having a non-adhesive strip removably attached thereto.

3. The collar corrector of claim 1, wherein the wire extends an entire length of the adhesive strip.

4. The collar corrector of claim 1 having a length that is less than a length of the shirt collar.

5. The collar corrector of claim 1 having a length that is sized to a length of the shirt collar.

6. The collar corrector of claim 1, wherein the adhesive strip is formed from at least one of cloth or plastic.

7. The collar corrector of claim 1, wherein the wire is a 19 gauge wire.

8. A method of correcting a shirt collar comprising:

providing a collar corrector having a wire embedded within an adhesive strip, the wire being pliable to alter a shape of the collar corrector, the shape of the collar corrector being maintained by the wire, wherein the adhesive strip includes at least one adhesive side;

removably adhering the adhesive side of the collar corrector to the shirt collar by adhering a first portion of the adhesive strip to the shirt collar on a first side of a fold of the shirt collar and adhering a second portion of the adhesive strip to the shirt collar on a second side of the fold of the shirt collar so that the wire of the collar corrector is positioned adjacent to the fold in the shirt collar; and removing the collar corrector from the shirt collar after the shirt has been worn.

9. The method of claim 8 further comprising positioning an end of the collar corrector adjacent to an end of the collar.

10. The method of claim 8, wherein the collar corrector includes two adhesive sides, the method further comprising:

removably adhering a first adhesive side of the collar corrector to a shirt collar of a first shirt;

removing the collar corrector from the shirt collar of the first shirt after the first shirt has been worn; and removably adhering a second adhesive side of the collar corrector to a shirt collar of a second shirt.

11. The method of claim 8, wherein the first side of the fold comprises a lower portion of the shirt collar, and wherein the second side of the fold comprises an upper portion of the shirt collar.

12. A method, comprising the steps of:

removing a first non-adhesive strip from a first adhesive side of an adhesive strip of a collar corrector, the collar corrector having a wire embedded within the adhesive strip, the wire being pliable to alter a shape of the collar corrector, the shape of the collar corrector being maintained by the wire; and removably adhering the first adhesive side of the adhesive strip to a shirt collar of a first shirt by adhering a first portion of the first adhesive side of the adhesive strip to the shirt collar on a first side of a fold of the shirt collar and adhering a second portion of the first adhesive side of the adhesive strip to the shirt collar on a second side of the fold of the shirt collar so that a wire of the collar corrector is positioned adjacent to the fold in the shirt collar.

13. The method of claim 12, further comprising the step of:

bending the wire of the collar corrector to alter a shape of the shirt collar.

14. The method of claim 12, further comprising the step of:

removing the collar corrector from the shirt collar;

removing a second non-adhesive strip from a second adhesive side of the adhesive strip of the collar corrector; and removably adhering the second adhesive side of the adhesive strip to a shirt collar of a second shirt by adhering a first portion of the second adhesive side of the adhesive strip to the shirt collar of the second shirt on a first side of a fold of the shirt collar of the second shirt and adhering a second portion of the second adhesive side of the adhesive strip to the shirt collar of the second shirt on a second side of the fold of the shirt collar of the second shirt so that the wire of the collar corrector is positioned adjacent to the fold in the shirt collar of the second shirt.

15. The method of claim 13, further comprising the step of:

removing the collar corrector from the shirt collar;

removing a second non-adhesive strip from a second adhesive side of the adhesive strip of the collar corrector; and removably adhering the second adhesive side of the adhesive strip to a shirt collar of a second shirt by adhering a first portion of the second adhesive side of the adhesive strip to the shirt collar of the second shirt on a first side of a fold of the shirt collar of the second shirt and adhering a second portion of the second adhesive side of the adhesive strip to the shirt collar of the second shirt on a second side of the fold of the shirt collar of the second shirt so that the wire of the collar corrector is positioned adjacent to the fold in the shirt collar of the second shirt.

16. The method of claim 14, further comprising the step of:

bending the wire of the collar corrector to alter a shape of the shirt collar of the second shirt.

17. The method of claim 13, wherein the bending step is performed to provide less flare to the collar.

18. The method of claim 13, wherein the bending step is performed to provide more flare to the collar.

* * * * *